US005785019A

United States Patent [19]

Akagi et al.

[11] Patent Number: 5,785,019

[45] Date of Patent: Jul. 28, 1998

[54] FUEL INJECTION SYSTEM FOR INTERNAL COMBUSTION ENGINE

[75] Inventors: Jiro Akagi; Masaki Takahashi; Hiroki Satow; Godo Ozawa, all of Tochigi-ken; Noriaki Nakane, Aichi-ken, all of Japan

[73] Assignee: Komatsu Ltd., Japan

[21] Appl. No.: 836,430

[22] PCT Filed: Nov. 6, 1995

[86] PCT No.: PCT/JP95/02258

§ 371 Date: Apr. 29, 1997

§ 102(e) Date: Apr. 29, 1997

[87] PCT Pub. No.: WO96/14503

PCT Pub. Date: May 17, 1996

[30] Foreign Application Priority Data

Nov. 4, 1994 [JP] Japan ..... 6-271144

[51] Int. Cl.[6] ..... F02D 31/00

[52] U.S. Cl. ..... 123/365; 123/367

[58] Field of Search ..... 123/364, 365, 123/366, 372, 367, 383

[56] References Cited

U.S. PATENT DOCUMENTS

| | | | |
|---|---|---|---|
| 4,782,804 | 11/1988 | Lehmann | 123/365 |
| 4,785,778 | 11/1988 | Gibson et al. | 123/365 |
| 5,195,490 | 3/1993 | Maier | 123/365 |
| 5,255,652 | 10/1993 | Boehm et al. | 123/366 |
| 5,325,831 | 7/1994 | Handa | 123/365 |

FOREIGN PATENT DOCUMENTS

| | | |
|---|---|---|
| 49-47533 | 12/1974 | Japan . |
| 61-36137 | 3/1986 | Japan . |
| 2-37121 | 2/1990 | Japan . |

*Primary Examiner*—Thomas N. Moulis
*Attorney, Agent, or Firm*—Rader, Fishman & Grauer

[57] ABSTRACT

A fuel injection system for an internal combustion engine includes a fuel injection pump injecting a fuel in an amount corresponding to a position of a control rack, a governor including a start spring, a control spring and an idling sub-spring biasing the control rack in a fuel injection amount increasing direction, an adjusting lever adjusting a spring load of the control spring, and a fly weight rotating together with the fuel injection pump and shifting the control rack in a fuel injection amount decreasing direction by a centrifugal force, and a stopper mechanism restricting movement of the control rack in the fuel injection amount increasing direction, wherein the stopper mechanism comprising a stopper opposing to an end portion of the control rack and an elastic body biasing and holding the stopper at a stop position, an elastic force of the elastic body being set to be greater than a sum of a spring load of the start spring and a spring load of the idling sub-spring while the adjusting lever is in an idling position and to be smaller than a sum of the spring load of the start spring, a spring load of the control spring and the spring load of the idling sub-spring while the adjusting lever is in partial position.

6 Claims, 8 Drawing Sheets

FUEL INJECTION SYSTEM FOR INTERNAL COMBUSTION ENGINE

FIELD OF THE INVENTION

The present invention relates to a fuel injection system for an internal combustion engine.

BACKGROUND ART

Conventionally, as a fuel injection system for an internal combustion engine mounted on a construction machine, an industrial machine or so forth, one constructed with a fuel injection pump and a governor has been known.

The fuel injection pump has a control rack to increase and decrease fuel injection amount by shifting a control rack. On the other hand, the governor includes an adjusting lever, a plurality of levers, a control spring, a start spring, a fly weight rotating together with a camshaft of the fuel injection pump, a control block, and idling sub-spring and so forth. In the normal operation state, the adjusting lever is rocked by an operation member to vary the position thereof to increase and decrease a spring load of the control spring. Also, by shifting the control block depending upon a revolution speed of the internal combustion engine by the fly weight, the control rack is shifted to control the fuel injection amount and whereby the revolution speed of the internal combustion engine is controlled by the position of the adjusting level.

In concrete, the control rack is biased in a fuel injection amount increasing direction by the spring load of the start spring, and is shifted in a fuel injection amount decreasing direction against the spring load of the control spring according to increasing the revolution speed of the internal combustion engine by a centrifugal force of the fly weight.

Therefore, when the adjusting lever is rocked from the idling position to a full-speed position, the position of the control rack is controlled depending upon the engine revolution speed and the adjusting lever position so as to establish equilibrium between the spring load of the control spring and the centrifugal force of the fly weight at any position.

It should be noted that, while the Anglich spring or so forth is provided in practice, the discussion therefor is neglected.

On the other hand, in order to facilitate starting up of the internal combustion engine at low temperature, the control rack is shifted in the fuel injection amount increasing direction beyond the full-load position by the start spring irrespective of the position of the adjusting lever to permit injection of increased amount of the fuel. The increasing amount (hereinafter referred to starting-up enrichment amount) is determined depending upon start-up characteristics of the engine.

Therefore, in the above-mentioned fuel injection system, upon stopping of the engine (while the fly weight is closed), the control rack is shifted in the fuel injection amount increasing direction until it contacts with a stopper by the start spring irrespective of the position of the adjusting lever and whereby the control rack is shifted in the fuel increasing position beyond the full load position to obtain the foregoing start-up enrichment.

As set forth above, in the construction where the control rack is shifted in the fuel injection increasing amount until it abuts on the stopper by the start spring to set the fuel injection amount upon starting-up, the control rack cannot be placed at the position for lesser injection amount than the full-load position to make the fuel injection amount upon starting-up large.

On the other hand, the fuel injection amount upon starting-up is required to be large when the external temperature is low (hereinafter referred to as cold start condition), and can be smaller when the external temperature is high (hereinafter referred to as normal temperature start-up condition). In addition, greater fuel injection amount should make the exhaust gas color worse.

Therefore, when the fuel injection amount upon starting-up is large as set forth above, while the start-up characteristics under cold start-up condition is improved, it can degrade exhaust gas color under normal temperature start-up condition.

Therefore, it is an object of the present invention to provide a fuel injection system for an internal combustion engine which can make exhaust gas color at the normal temperature start-up condition better, can improve the cold start-up characteristic and can make the exhaust gas color better upon starting-up of the supercharged internal combustion engine.

DISCLOSURE OF THE INVENTION

In order to accomplish the foregoing object, according to one aspect there is provided a fuel injection system for an internal combustion engine which comprises a fuel injection pump injecting a fuel in an amount corresponding to a position of a control rack;

a governor including a start spring, a control spring and an idling sub-spring biasing the control rack in a fuel injection amount increasing direction, an adjusting lever adjusting a spring load of the control spring, and a fly weight rotating together with the fuel injection pump and shifting the control rack in a fuel injection amount decreasing direction by a centrifugal force; and a stopper mechanism restricting movement of the control rack in the fuel injection amount increasing direction, wherein the stopper mechanism comprises a stopper opposing to an end portion of the control rack and an elastic body biasing and holding the stopper at a stop position, an elastic force of the elastic body is set to be greater than a sum of a spring load of the start spring and a spring load of the idling sub-spring while the adjusting lever is in an idling position and to be smaller than a sum of the spring load of the start spring, a spring load of the control spring and the spring load of the idling sub-spring while the adjusting lever is in partial position.

With the construction set forth above, by adjusting the spring load of the control spring by shifting the adjusting lever between the idling position and the partial position, the control rack can be shifted between the first position where the control-rack abuts against a stopper and the second position where the stopper is shifted against the elastic body.

Accordingly, in the normal temperature start-up, by placing the adjusting lever at the idling position, the fuel injection amount upon normal temperature start-up can be reduced, and upon cold start-up, the adjusting lever is placed at the partial position, the fuel injection amount upon cold start-up can be increased. Therefore, the exhaust gas color at normal temperature start-up good, and in conjunction therewith, cold start-up characteristics can be improved. Also, the position of the control rack upon starting-up can be shifted in the fuel injection amount decreasing direction than the maximum fuel injection amount position (full-load position) of the control rack at normal temperature start-up. Therefore, fuel injection amount upon starting-up can be reduced. Thus, exhaust gas color upon starting up of a supercharged internal combustion engine good.

It is also possible that an Angleich spring is provided in a governor in addition to the construction set forth above, an elastic force of the elastic body of the stopper mechanism is set to be greater than a sum of the spring load of the start spring, a spring load of the idling sub-spring and a spring load of the Angleich spring while the adjusting lever is in idling position and to be smaller than the sum of the spring load of the start spring, the spring load of the control spring and the spring load of the idling sub-spring while the adjusting lever is in partial position.

Also in addition to the foregoing construction, it is preferred that the stop position of the stopper mechanism is adjustable in a shifting direction of the control rack.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

BEST MODE FOR IMPLEMENTING THE INVENTION

The preferred embodiment of a fuel injection system for an internal combustion engine according to the present invention will be discussed hereinafter with reference to the accompanying drawings.

Figure 1:
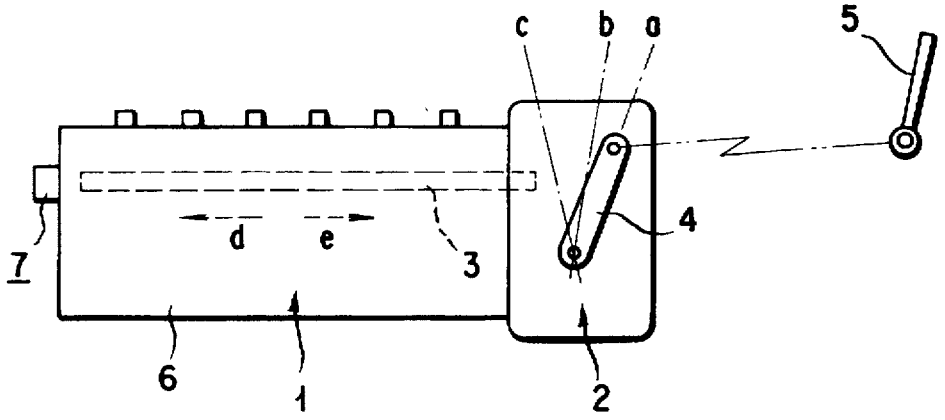
FIG. 1 is a overall external view of the first embodiment of a fuel injection system according to the present invention.

As shown in FIG. 1, a fuel injection system is constructed with a fuel injection pump 1 and a governor 2. The fuel injection pump 1 is adapted to inject a fuel in amount corresponding to a position of a control rack 3. The governor 2 may shift the control rack 3 in a fuel injection amount increasing direction (arrow d direction) or a fuel injection amount decreasing direction (arrow e direction) by rocking an adjusting lever 4 between a stop position a, an idling position b, and a full-speed position c by an operation member 5, such as a fuel control lever or an accelerator pedal. On the other hand, by a later discussed fly weight, the control rack 3 is shifted in a fuel injection increasing amount or a fuel injection decreasing amount. In the pump housing 6 of the fuel injection pump 1, a stopper mechanism 7 is mounted for restricting unnecessarily large magnitude of shift of the tip end of the control rack 3.

The governor 2 includes an adjusting lever 4 pivoted on a not shown engine body, a swiveling lever 10 integrated with the adjusting lever 4, a tension lever 11 pivoted on the not shown engine body, a guide lever 12 pivoted on the not shown engine body coaxially with the tension lever 11, a control lever 13 pivoted on the not shown engine body via a pin 22, a fly weight 14 rotating with a camshaft of the fuel injection pump, a control block 15 to be shifted in the longitudinal direction by opening and closing operation by centrifugal force of the fly weight 14, and a fluid stopper 16 fixed to the not shown engine body for restricting leftward turn of the tension lever 11 at a predetermined position. Then, the tip end of the guide lever 12 is connected to the control block 15. The control lever 13 is connected to the guide lever 12 via the pin 17. The control lever 13 is connected to the rear end of the control rack 3 by a link 19. Furthermore, between a tension lever 11 and swiveling lever 10, a control spring 18 is stretched. A start spring 20 is stretched between the tip end of the control lever 13 and a pump housing 6. An idling sub-spring 21 is provided in opposition to the side portion of the tension lever 11.

The control block 15 is biased in a direction (direction of arrow f) for preventing opening of the fly weight via the tip end of the tension lever 11 by a spring load of the control spring 18. The spring load of the control spring 18 is zero at the stop position a and idling position b of the adjusting lever 4 and becomes maximum at the full-speed position c. On the other hand, the tension lever 11 is rocked in the clockwise direction until it abuts to the full load stopper 16 by a spring load of the control spring 18. The control block 15 is shifted in the direction of arrow g by opening the fly weight 14 to rock the tension lever 11 in the counterclockwise direction to push the idle sub-spring 21.

On the swivel lever 10, a projection 23 is provided. When the adjusting lever 4 is rocked in the clockwise direction toward the stopper position a, the projection 23 contact with the control lever 13 to mechanically bring the control rack 3 to the stop position A.

Since the governor 2 is constructed as set forth above, when the adjusting lever 4 is located at the idling position b in response to action of the fly weight 14 and the control signal 18 to place the control rack 3 at the idling position B. When the adjusting lever 4 is placed at the full speed position c, the control rack is controlled to be placed at the full-load position C.

Figure 3:
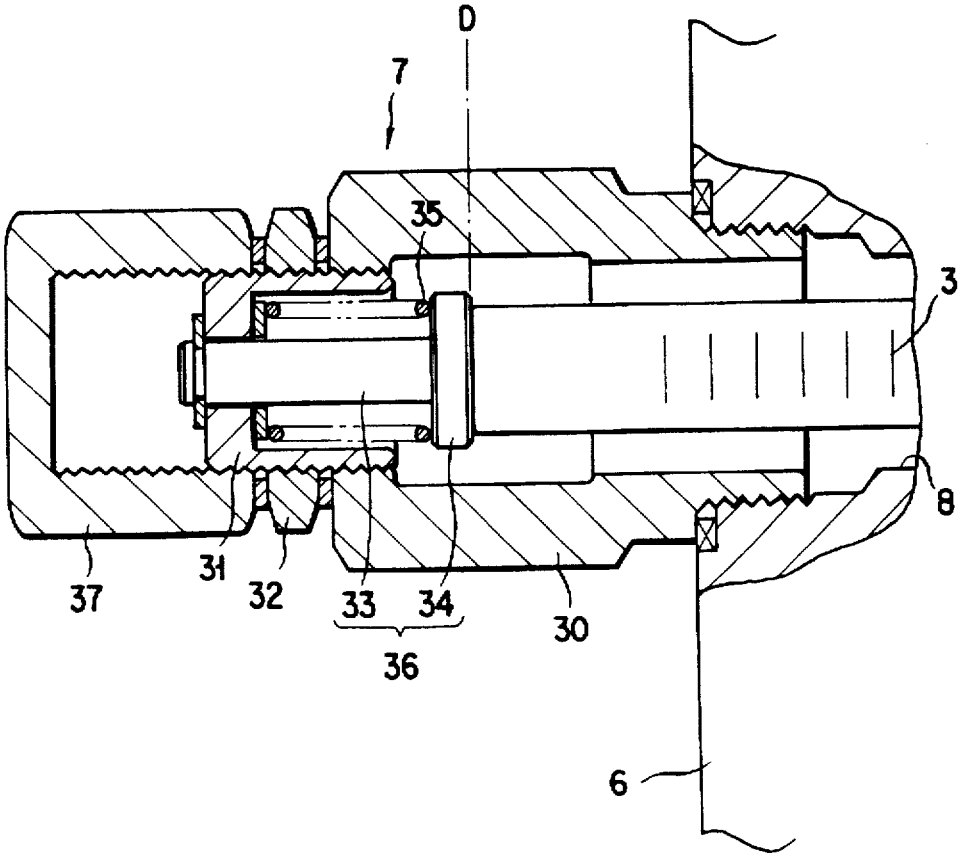
FIG. 3 is a section showing one embodiment of the first embodiment of a stopper mechanism.

On the other hand, the stopper mechanism 7 is constructed as shown in FIG. 3. Namely, at the opposite side of the governor 2 of a control rack insertion hole 8 of the pump housing 6, a cylinder body 30 is threadingly mounted. To the cylinder body 30, a spring receptacle 31 is threaded and is fixed by tightening of the rock nut 32. In the spring receptacle 31, a rod 33 is slidably inserted. Between a flange 34 integrally provided at the inner end portion of the rod 33 and the spring receptacle 31, a spring 35 to bias and hold the flange 34 toward right in the drawing is arranged. These form a stopper 36. On the other hand, a cap 37 is threadingly engaged with the spring receptacle 31. By loosening the cap and loosening the rock nut 32 and tightening and loosening the spring receptacle 31, the position D of the spring 36 can be adjusted in the shifting direction of the control rack 3.

Next, starting-up of the internal combustion engine will be discussed in touching with a relationship between the position of the stopper 36 of the stopper mechanism 7 and the position of the control rack 3.

Figure 2:
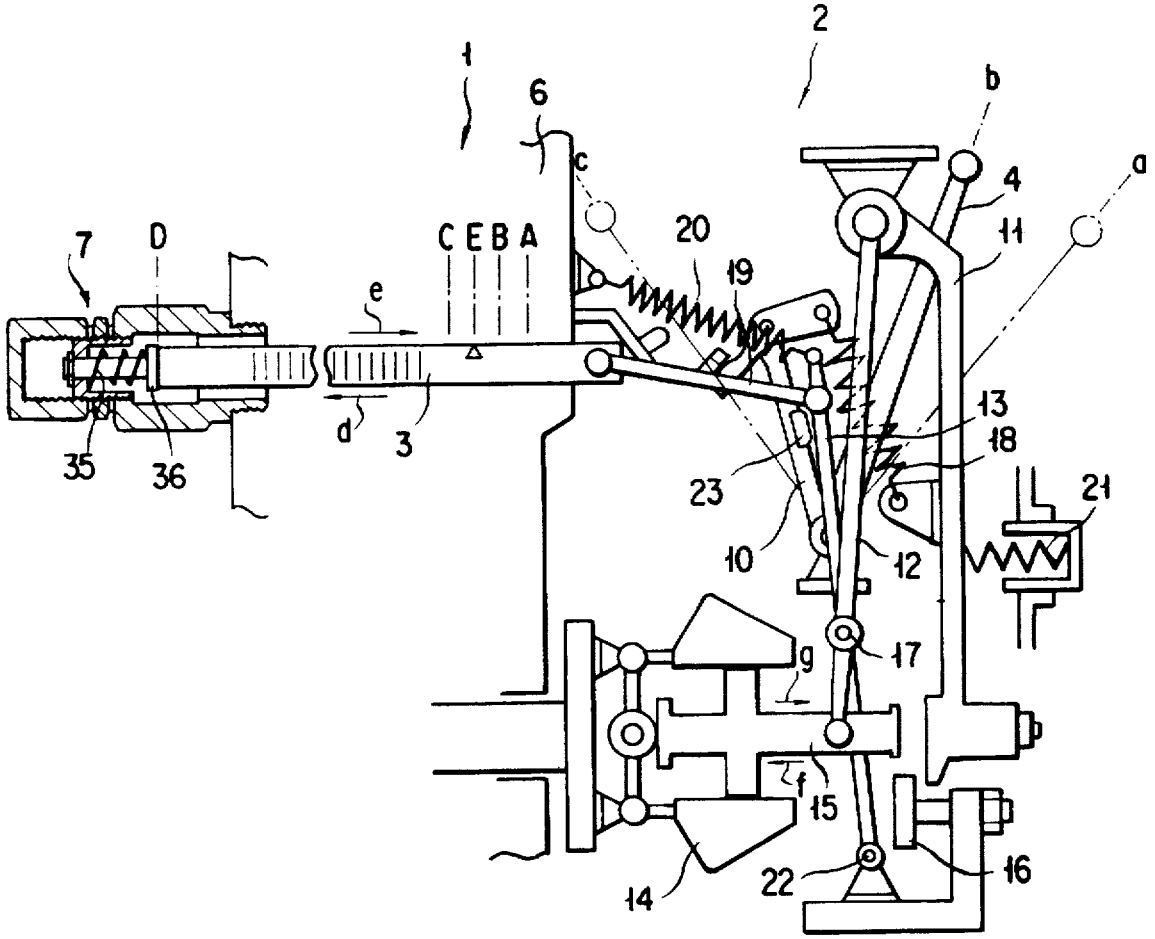
FIG. 2 is an illustration showing the construction of the foregoing first embodiment and an operation under normal temperature start-up.

As shown in FIG. 2, at stopping condition of the internal combustion engine and when the adjusting lever 4 is in the idling position b, the spring load of the control spring 18 is zero. Thus, the tension lever 11 is in free condition. Accordingly, the control rack 3 is shifted in the direction of arrow d by the spring load of the start spring 20 to contact with the stopper 36. Then, the control rack 3 is in start position E. The start position E is the intermediate position (the fuel injection amount decreasing position from the full load position C) between the idling position B and the full load position C, and increasing of the fuel injection amount upon starting-up is set smaller than the example which does not have the stopper mechanism 7.

Next, at this condition, when starting-up operation of the internal combustion engine is effected, the fly weight 14 tends to shift the control block 15 in the direction of arrow g. However, due to the spring load of the start spring 20, the control rack 3 is biased in the direction of arrow d. On the other hand, when the control block 15 is about shifting in the direction of arrow g, the tension lever 11 is depressed onto the idling sub-spring 21. At this time, by the spring load of the idling sub-spring 21, the tension lever 11 is supported.

By this, the control rack 3 is biased in the direction of allow to abut onto the stopper 36 via the tension lever 11, the control block 15, the guide lever 12, the control lever 13 and the link 19. Since the biasing force is resisted by the spring load of the spring 35, the control rack can be held at the start position E set forth above.

Namely, the set spring load of the spring 35 of the spring mechanism 7 is set to be greater than a sum of the set spring load of the start spring 20 and the set spring load of the idling sub-spring 21 at the idling position.

It should be appreciated that in case of the governor 2, in which the idling sub-spring 21 becomes not active when the adjusting lever 4 is in the idling position b, the set spring load of the spring 35 may be set greater than the set spring load of the start spring 20.

As set forth above, the fuel injection amount during normal temperature start-up can be reduced to make the exhaust gas color good.

Figure 4:
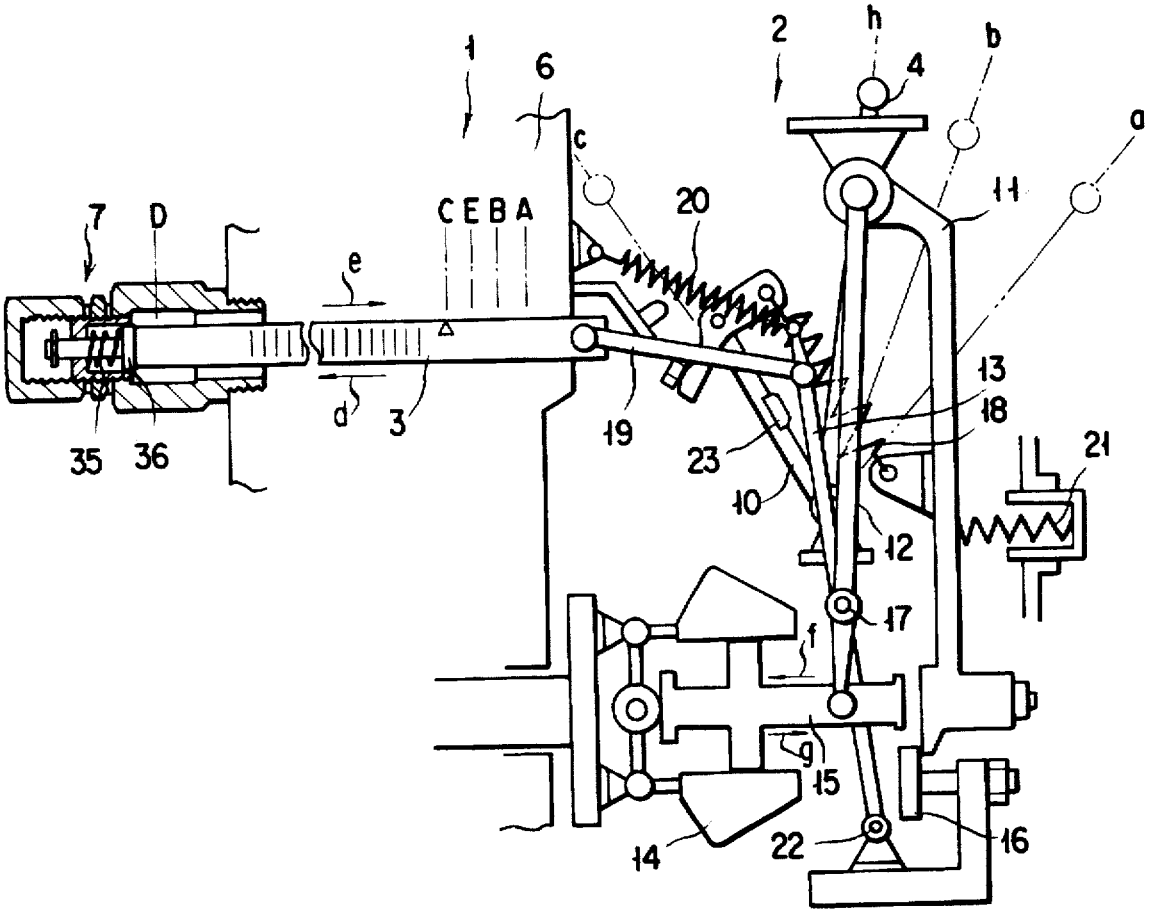
FIG. 4 is an illustration showing the operation under cold start-up in the first embodiment.

On the other hand, upon cold start-up, as shown in FIG. 4, the adjusting lever 4 is rocked from the idling position b toward the full speed position to be placed at a partial position h. Then, a spring force is generated in the control spring 18 to rotate the tension lever 11 in clockwise direction so that the control rack 3 may be biased in the direction of arrow d via the control block 15, the guide lever 12, the control lever 13 and the link 19. The control rack 3 is stopped at a position where the tension lever 11 abuts onto the full-load stopper 16.

At this time, since a sum of the spring load of the start spring 20, the spring load of the idling sub-spring 21 and the spring load of the control spring 18 becomes greater than the spring load of the spring 35. The, by the sum of the spring loads, the control rack 3 is biased in the direction of arrow d. Therefore, the stopper 36 is shifted toward left against the spring 35, the control rack 3 is placed at the full-speed position C.

Accordingly, upon cold start, the fuel injection amount becomes maximum fuel injection amount to improve start-up characteristics.

Figure 5:
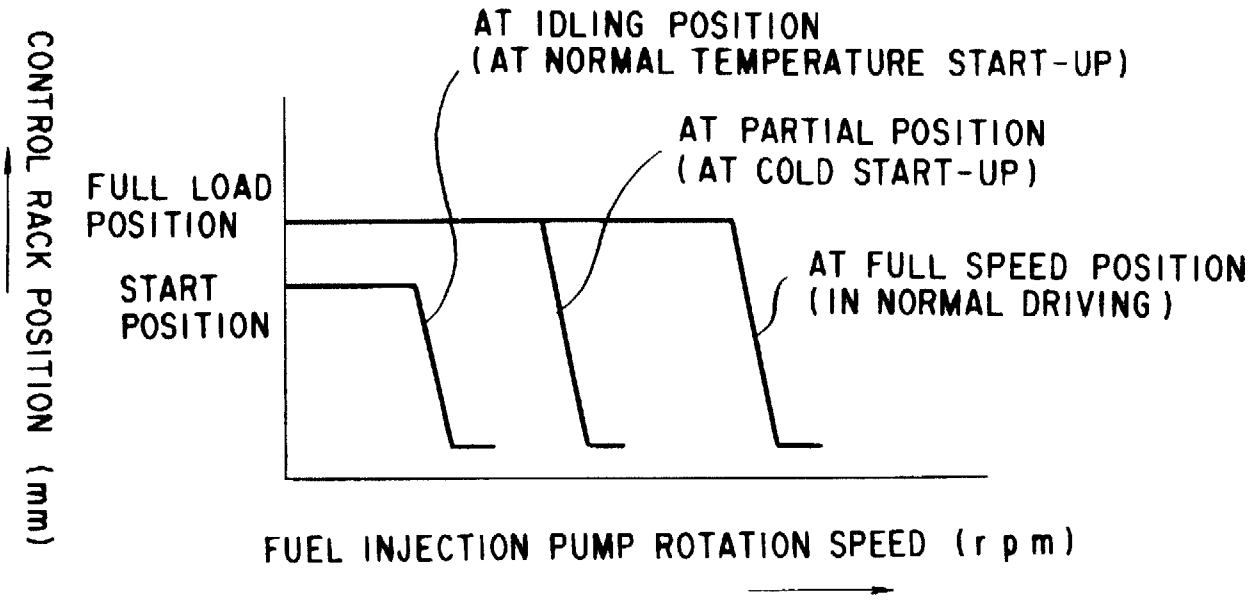
FIG. 5 is a chart showing a relationship between a control rack position and a revolution speed of a fuel injection pump in the first embodiment.

The foregoing may be expressed as a chart as shown in FIG. 5.

It should be noted that in case of the governor, in which the idling sub-spring 21 becomes inactive when the adjusting lever 4 is in the partial position h, the spring load of the spring 35 may be set to be smaller than a sum of the set spring load of the start spring 20 and the spring load of the control spring 18.

Figure 6:
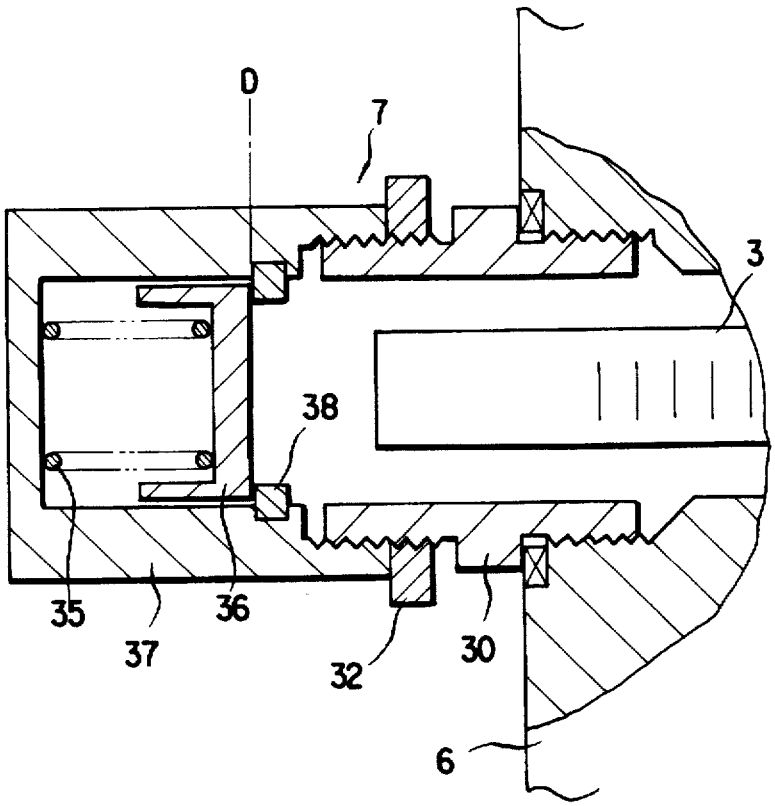
FIG. 6 is a section showing another embodiment of the stopper mechanism.

On the other hand, the stopper mechanism 7 may be constructed as shown in FIG. 6.

In this, the cap 37 is threadingly engaged with the cylindrical body 30 and fixed by tightening of the rock nut 32 to movably dispose the stopper 36, and the stopper 36 is biased toward the side of the control rack 3 to abut onto a snap ring 38.

With the construction set forth above, the position D of the stopper 36 can be adjusted by tightening and loosening the cap 37 by loosening the rocking nut 32.

It should be noted that an elastic body, such as a rubber, a pneumatic piston and so forth can be employed in place of the foregoing spring 35.

Figure 7:
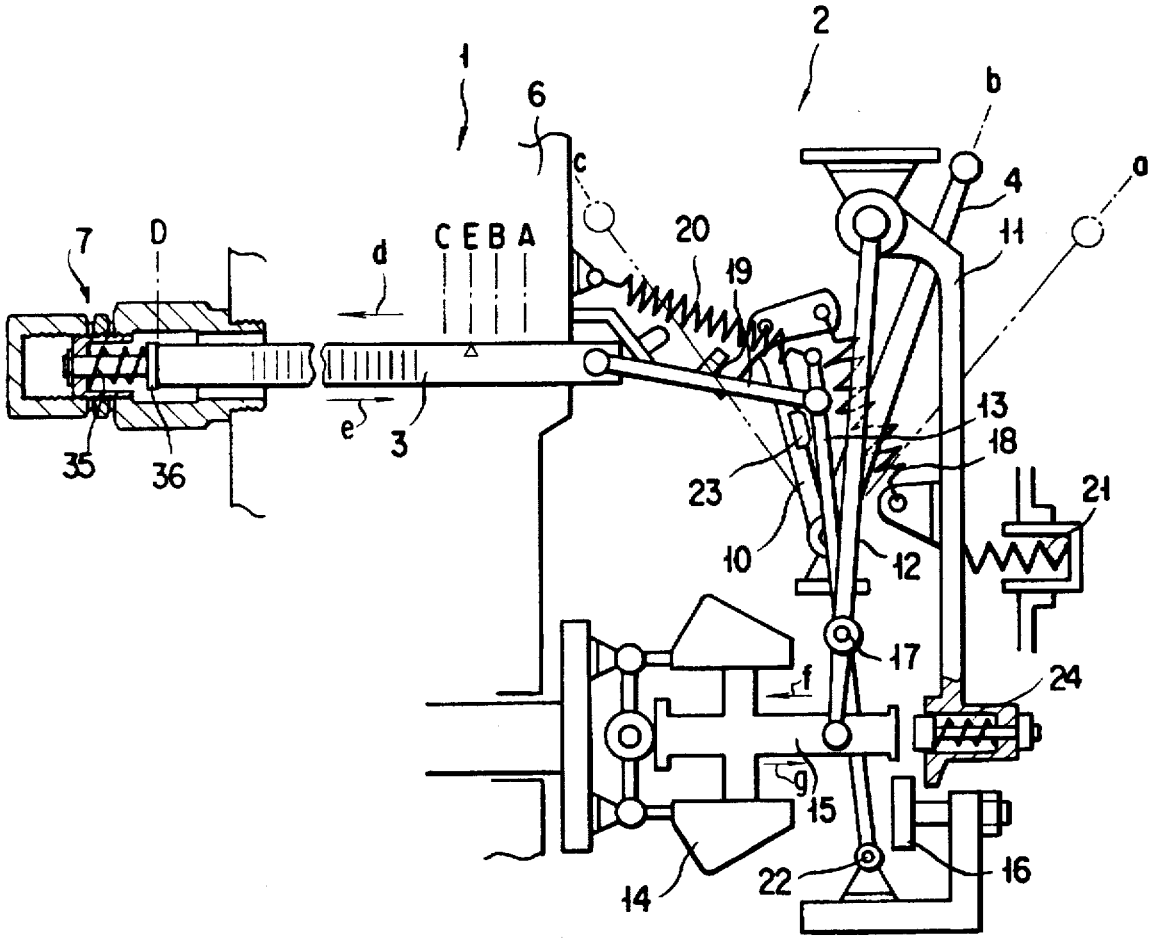
FIG. 7 is an illustration showing an the construction and operation upon normal temperature start-up in the second embodiment of the fuel injection system according to the present invention.

FIG. 7 shows the second embodiment. This includes Angleich spring mechanism 24 is provided at the tip end of the tension lever 11 opposing to the control block 15. The Angleich spring mechanism 24 biases the control block 15 in the direction of the arrow f to shift the control rack 3 in the direction of arrow d (fuel injection amount increasing direction).

With such construction, with placing the adjusting lever 4 at the partial position h, when the tension lever 11 is abut against the full-load stopper 16, the Angleich mechanism 24 further biases the control block 15 in the direction of arrow f. Therefore, the control rack 3 is further pushed in the direction of the arrow d by the spring load of the Angleich spring mechanism 24.

By this, upon the above-mentioned cold start, the control rack 3 is further shifted in the fuel injection amount increasing direction to increase fuel injection amount upon start up. Also, when the revolution speed of the internal combustion engine is lowered during normal driving condition where the adjusting lever 4 is placed at the full-speed position c, the fly weight 14 is shifted in the closing direction to shift the control rack 3 in the fuel injection amount increasing direction beyond the full-load position C by the Angleich spring mechanism 24.

Figure 8:
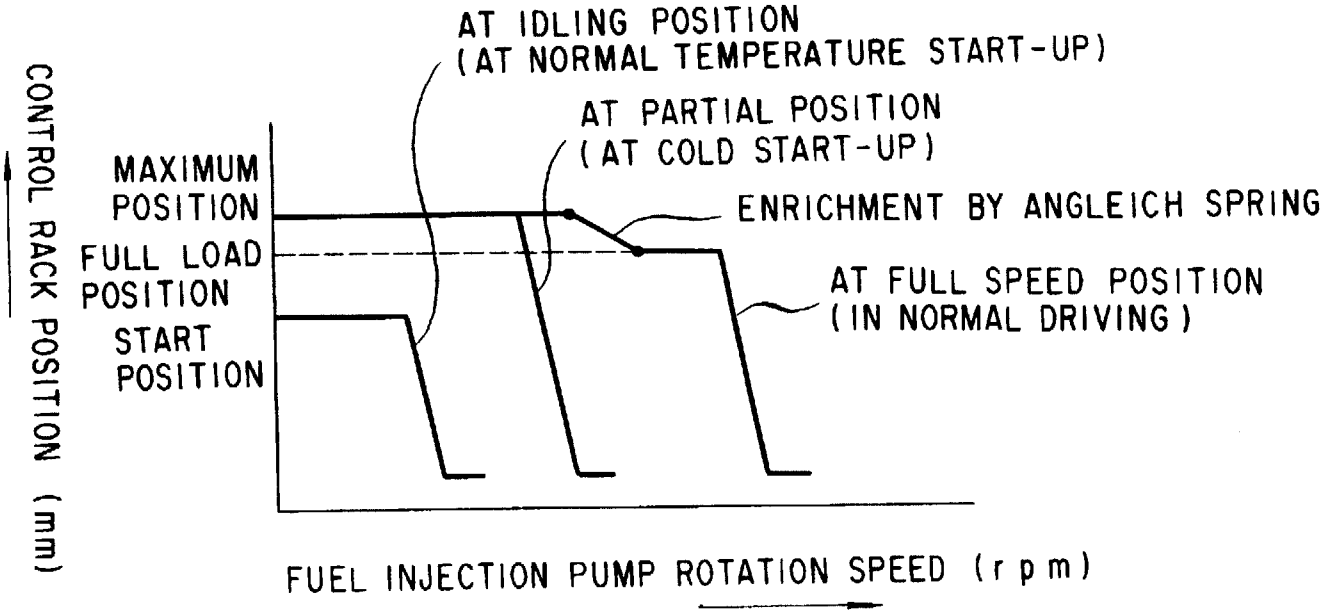
FIG. 8 is a chart showing a relationship between the control rack position and the revolution speed of the fuel injection pump by the second embodiment.

This will be illustrated in a form of chart as shown in FIG. 8.

It should be noted that, in any embodiments set forth above, the stopper mechanism 7 is constructed as shown in FIG. 3 or FIG. 6 to permit adjustment of the position of the stopper 36. Therefore, the start position of the control rack 3 can be arbitrarily adjusted.

With the construction set forth above, by adjusting the spring load of the control spring 18 by shifting the adjusting lever 4 to the idling position or the partial position, the control rack 3 can be shifted to the first position contacting with the stopper 36 and the second position where the stopper 36 is shifted against the elastic body.

Accordingly, under the normal temperature start-up, the adjusting lever 4 is placed at the idling position, the fuel injection amount under normal temperature start-up can be reduced, whereas, upon cold start, the fuel injection amount can be increased. Therefore, the exhaust gas color under normal temperature start-up can be held good, and start-up characteristics under the cold start-up can be held good. Also, since the position of the control rack 3 can be shifted in the fuel injection amount decreasing direction than the maximum position (full-load position) to reduce the fuel injection amount at starting-up. Thus, the exhaust gas color upon starting-up can be held good.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

We claim:

1. A fuel injection system for an internal combustion engine comprising:

a fuel injection pump injecting a fuel in an amount corresponding to a position of a control rack;

a governor including a start spring, a control spring and an idling sub-spring biasing said control rack in a fuel injection amount increasing direction, an adjusting lever adjusting a spring load of said control spring, and a fly weight rotating together with said fuel injection pump and shifting said control rack in a fuel injection amount decreasing direction by a centrifugal force; and a stopper mechanism restricting movement of said control rack in the fuel injection amount increasing direction, wherein said stopper mechanism comprises a stopper opposing to an end portion of said control rack and an elastic body biasing and holding said stopper at a stop position, an elastic force of said elastic body is set to be greater than a sum of a spring load of said start spring and a spring load of said idling sub-spring while said adjusting lever is in an idling position and to be smaller than a sum of the spring load of said start spring, a spring load of said control spring and the spring load of said idling sub-spring while said adjusting lever is in partial position.

2. A fuel injection system for an internal combustion engine as set forth in claim 1, wherein an Angleich spring is provided in a governor, an elastic force of said elastic body of said stopper mechanism is set to be greater than a sum of the spring load of said start spring, a spring load of said idling sub-spring and a spring load of said Angleich spring while said adjusting lever is in idling position and to be smaller than the sum of the spring load of said start spring, the spring load of said control spring and the spring load of said idling sub-spring while said adjusting lever is in partial position.

3. A fuel injection system for an internal combustion engine as set forth in claim 1 or 2, wherein the stop position of said stopper mechanism is adjustable in a shifting direction of said control rack.

4. A fuel injection system for an internal combustion engine comprising:

a fuel injection pump injecting a fuel in an amount corresponding to a position of a control rack;

a governor including a start spring and a control spring biasing said control rack in a fuel injection amount increasing direction, an adjusting lever adjusting a spring load of said control spring, and a fly weight rotating together with said fuel injection pump and shifting said control rack in a fuel injection amount decreasing direction by a centrifugal force; and a stopper mechanism restricting movement of said control rack in the fuel injection amount increasing direction, wherein said stopper mechanism comprises a stopper opposing to an end portion of said control rack and an elastic body biasing and holding said stopper at a stop position, an elastic force of said elastic body is set to be greater than a spring load of said start spring while said adjusting lever is in an idling position and to be smaller than a sum of the spring load of said start spring and a spring load of said control spring while said adjusting lever is in partial position.

5. A fuel injection system for an internal combustion engine as set forth in claim 4, wherein an Angleich spring is provided in a governor, an elastic force of said elastic body of said stopper mechanism is set to be greater than a sum of the spring load of said start spring and a spring load of said Angleich spring while said adjusting lever is in idling position and to be smaller than the sum of the spring load of said start spring, the spring load of said control spring and the spring load of said idling sub-spring while said adjusting lever is in partial position.

6. A fuel injection system for an internal combustion engine as set forth in claim 4 or 5, wherein the stop position of said stopper mechanism is adjustable in a shifting direction of said control rack.

* * * * *